United States Patent [19]

Takagi et al.

[11] Patent Number: 4,873,931

[45] Date of Patent: Oct. 17, 1989

[54] PROGRAMMED THREAD REGULATING APPARATUS FOR A SEWING MACHINE

[75] Inventors: Katsumi Takagi; Toshihito Negoro; Itaru Tamagawa, all of Osaka, Japan

[73] Assignee: Pegasus Sewing Machine Mfg. Co., Ltd., Osaka, Japan

[21] Appl. No.: 192,093

[22] Filed: May 10, 1988

[30] Foreign Application Priority Data

May 11, 1987 [JP] Japan ..... 62-114971

[51] Int. Cl.[4] ..... D05B 19/00; D05B 47/04

[52] U.S. Cl. ..... 112/121.11; 112/255

[58] Field of Search ..... 112/254, 255, 121.11; 242/150 R; 66/213, 146

[56] References Cited

U.S. PATENT DOCUMENTS

| | | | |
|---|---|---|---|
| 4,254,723 | 3/1981 | Rothstein | 112/255 |
| 4,408,554 | 10/1983 | Takiguchi et al. | 112/302 |
| 4,452,156 | 6/1984 | Teetz et al. | 112/255 X |
| 4,566,396 | 1/1986 | Sukuma et al. | 112/302 |
| 4,590,879 | 5/1986 | Matsubara et al. | 112/278 |
| 4,632,048 | 12/1986 | Matsubara | 112/262.1 |
| 4,682,554 | 7/1987 | Goto et al. | 112/262.1 |
| 4,726,308 | 2/1988 | Aida et al. | 112/254 |

*Primary Examiner*—Peter Nerbun

*Attorney, Agent, or Firm*—Armstrong, Nikaido, Marmelstein Kubovcik & Murray

[57] ABSTRACT

A thread regulating apparatus for a sewing machine having a plurality of thread regulators. Each regulator nips a thread between a pair of tension discs to apply tension to the thread. The tension applied to the thread is determined according to combination patterns of tension values stored in a memory.

17 Claims, 11 Drawing Sheets

Fig. 11

| | AREA D1 | AREA D3 |
|---|---|---|
| STEP S21 | 1 1 1 1 ⇦ | 1 1 1 1 |
| STEP S22 (SELECT PATTERN 2) | 2 1 2 1 | 1 1 1 1 |
| STEP S26 (START SW ON?) | 2 1 2 1 ⇨ | 2 1 2 1 |

Fig. 12

| | D1 | D3 |
|---|---|---|
| S21 | 1 1 1 1 | 1 1 1 1 |
| S25 SET SW ON | 1 1 1 1 | 1 1 1 1 |
| S28 | 2 1 2 1 ⇩ | 1 1 1 1 |
| S29 | 2 2 3 2 | |
| S30 | RENEW DATA 2 2 3 2 | 1 1 1 1 |
| S27 | 2 2 3 2 ⇨ | 2 2 3 2 |

PROGRAMMED THREAD REGULATING APPARATUS FOR A SEWING MACHINE

BACKGROUND OF THE INVENTION (1) Field of the Invention

The present invention relates to a thread regulating apparatus in a sewing machine having a plurality of thread regulators each including a pair of tension discs for holding a thread therebetween and applying tension to the thread.

(2) Description of the Prior Art

A thread used for stitching by a needle or a looper is usually drawn from a bobbin on which the thread is wound, and is passed through a needle hole. Since the needle moves at high speed in a stitching operation, the thread tends to be drawn in an unrestricted manner. This gives rise to the problem of a defective finish with loose stitches in the resulting product.

This problem of loose stitches is solved by applying a suitable tension to the thread at an intermediate position between the bobbin and the needle in a direction to arrest its movement toward the needle. FIG. 1 shows an example of a known thread regulator for applying such a tension to the thread. The regulator comprises a pair of tension discs 103 and 104 loosely mounted on a shaft 102 rigidly connected to a main machine frame 101. A spring 105 and a pressing screw 106 are mounted on the shaft 102 outwardly of one of the tension discs 103. This tension disc 103 is pressed on the other disc 104 through a compressive force of spring 105 by tightening the screw 106. Thus, tension is applied to the thread held between the two tension discs 103 and 104.

In a sewing machine having only one stitching needle, it is easy to apply the tension by means of the thread regulator and maintain an upper thread and a lower thread in a well-balanced relationship.

However, in the case of a sewing machine having a plurality of stitching needles or loopers for looping an edge and a plurality of thread regulators for applying tension to respective threads, it requires a great amount of skill to apply the tension to the threads in a balanced way, which renders a sewing operation difficult. There is another problem that, even if the pressing screw 106 is tightened to a selected degree, the tension could change with variations or secular changes in the urging force of spring 105.

SUMMARY OF THE INVENTION

A primary object of the present invention, therefore, is to provide a rationalized regulating apparatus for a sewing machine having a plurality of thread regulators.

Another object of the invention is to provide an apparatus for allowing each of a plurality of thread regulators to apply a desired tension with ease.

A further object of the invention is to provide an apparatus for allowing each of a plurality of thread regulators to vary the tension applied to a thread with ease.

The above objects are fulfilled, according to the present invention, by a thread regulating apparatus having a plurality of thread regulators each nipping a thread to apply tension to the thread. The tension is variable by changing a nip pressure. The apparatus comprises memory device for storing values of the tension of the thread applied by each thread regulator according to combination patterns of the values of the tension for the respective threads, a selecting device for selecting one of the combination patterns stored in the memory device, and an adjusting device for adjusting the nip pressure of each thread regulator in accordance with the selected combination pattern.

In a preferred embodiment of the invention, each thread regulator includes a pair of tension discs and an urging device for maintaining the tension discs in pressure contact with each other. The urging device is interposed between one of the tension discs and a movable block driven by a drive device. The urging device has an amount of compression which is adjustable by actuating the drive device to move the movable block toward and away from the tension discs.

The memory device may include a RAM table for storing, as associated with pattern numbers, the combination patterns of the values of the tension applied to the threads by the thread regulators.

The selecting device may include a switch for varying a pattern number shown on the display device. The drive device may include a stepper motor and a tension stud extending through and engaging the movable block for moving the movable block toward and away from the tension discs with rotations of the stepper motor. The drive device may further include a detecting element for detecting a zero-point position of the movable block at which the amount of compression of the urging device is a minimum. The tension applied to each thread is variable by an amount of movement of the movable block from a zero-point position.

In the construction according to the invention as set out above, values of the tension applied by a plurality of thread regulators are stored in combination patterns A desired pattern is selected from the stored patterns, and tension is provided to threads according to the selected pattern. This arrangement allows the tension to be readily set as desired, which enables an operator having little skill to carry out a sewing operation with high precision. The mean as provided above for selecting a desired pattern from the combination patterns and for varying tension data permits the tension to be set to optimal values by appropriately selecting the pattern stored in the memory or varying the pattern. Consequently, the thread regulating apparatus according to the invention is able to speedily cope with a change in the force of the urging device, e.g. springs, and with different materials of workpiece, thereby constantly maintaining excellent sewing precision.

BRIEF DESCRIPTION OF THE DRAWINGS

These and other objects, advantages and features of the invention will become apparent from the following description thereof taken in conjunction with the accompanying drawings which illustrate a specific embodiment of the invention In the drawings.

DESCRIPTION OF THE PREFERRED EMBODIMENT

Figure 1:
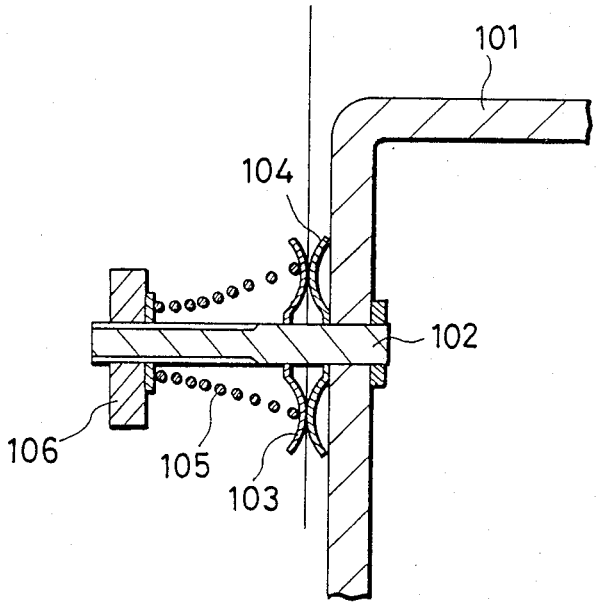
Fig. 1 (Prior Art)
FIG. 1 is a sectional view of a conventional thread regulator in a sewing machine.
Figure 2:
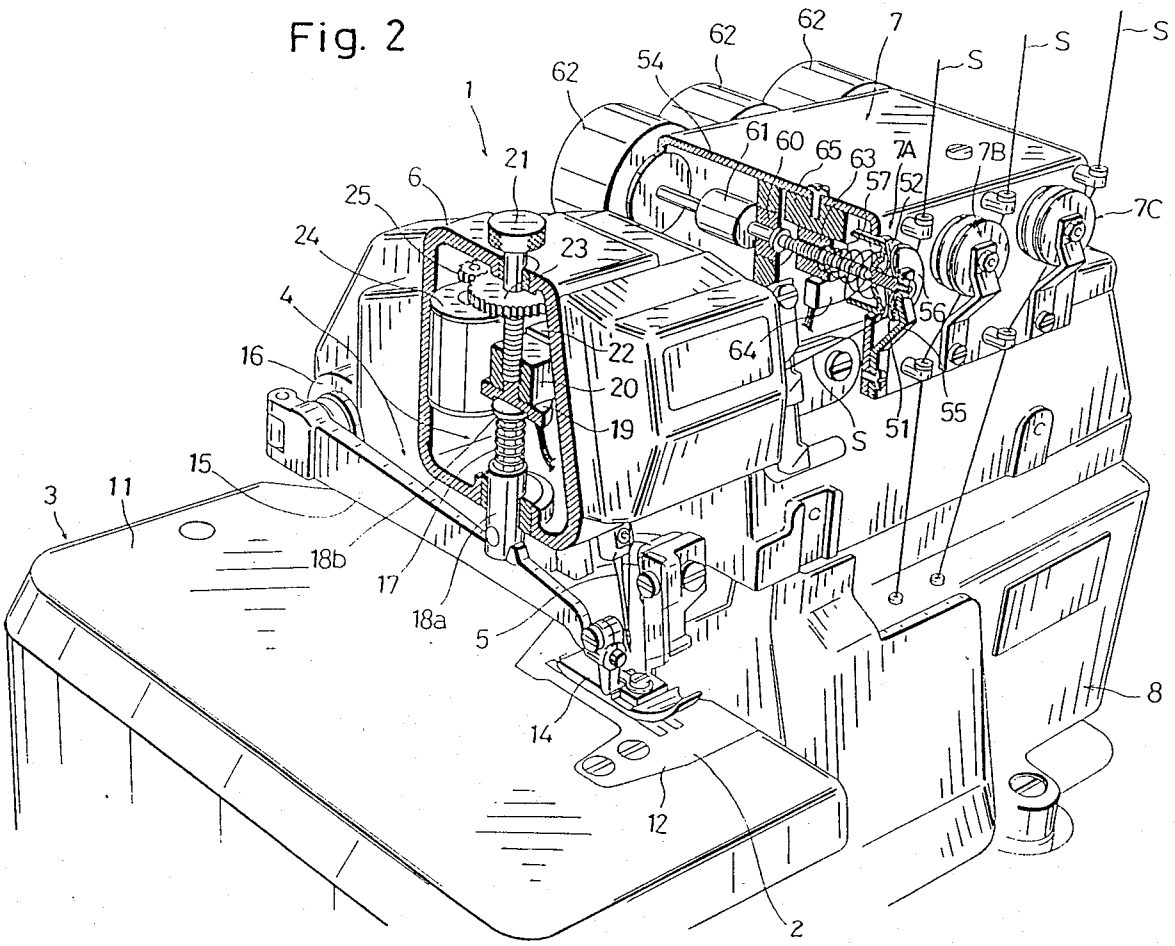
FIG. 2 is a perspective view, partly broken away, of an embodiment of the present invention.

An embodiment of the present invention will be described hereinafter. FIG. 2 is a perspective view, partly in section, of a thread regulating apparatus embodying the invention. In the drawing, number 1 indicates an overlock sewing machine which is one type of sewing machine. This sewing machine generally comprises a transport device 2 for supporting a fabric or other workpiece and transporting it at a predetermined pitch, a fabric table 3 for supporting the workpiece, a pressing device 4 for pressing the fabric on the fabric table 3 with a selected force, an arm assembly 6 carrying a stitching needle 5, a thread regulating device 7 for adjusting the tension of three threads extending to the needle 5 and loopers, and a main machine frame 8 housing the fabric table 3, arm assembly 6 and thread regulating device 7 in their respective optimal positions.

The fabric table 3 located at a lefthand side of the main machine frame 8 includes a flat fabric plate 11 placed on its top for supporting the fabric. The fabric plate 11 is continuous with a throat plate 12 disposed adjacent the transport device 2. The cloth being stitched is transported by a feed dog vertically movable above and below an upper surface of the throat plate 12 at a pitch synchronized with movement of the needle 5.

The pressing device 4 is attached to the arm assembly 6 extending to a position opposed to the fabric table 3 for pressing the fabric from above the fabric plate 11. The pressing device 4 includes a presser foot 14 attached to a distal end of a presser carrier 15 extending substantially parallel to the fabric table 11. The presser carrier 15 is moved away from the feed dog by a drive device 16 mounted at a proximal end of the presser carrier 15. A spring 17 is attached to an intermediate position of the presser carrier 15 through a presser bar 18*a* to apply a resilient force to the presser foot 14. Provided at the other end of the spring 17 are a pressure sensor 19 for detecting a pressing force through an auxiliary presser bar 18*b*, and a movable block 20 for supporting the pressure sensor 19 from behind. The movable block 20 is in threaded engagement with an adjusting screw 21 supported by the arm assembly 6, and is held against rotation by a guide 22 mounted on an inside wall of the arm assembly 6. Thus, the block 20 is slidable axially of the adjusting screw 21 with rotations of the screw 21. When the adjusting screw 21 is rotated in one direction, the movable block 20 moves downward to compress the spring 17 thereby to increase its resilient force. As a result, an increased pressing force is applied through the presser carrier 15 to the presser foot 14. Conversely, for weakening the pressing force, the screw 21 is rotated in the other direction to reduce the resilient force of the spring 17.

The adjusting screw 21 carries a gear 23 fixed thereto, which is meshed with a gear 25 mounted on an output shaft of a DC motor 24. The DC motor 24 is thus operable to rotate the adjusting screw 21.

Figure 3:
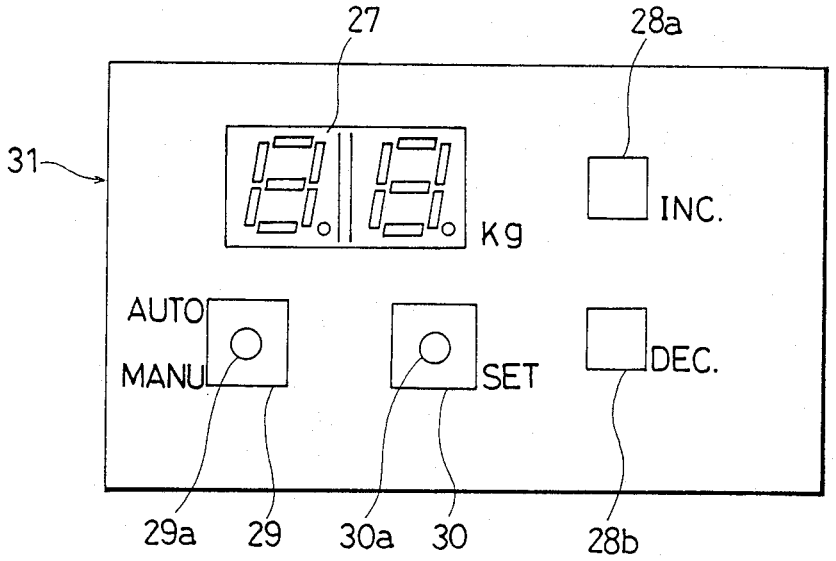
FIG. 3 is a front view of a display panel on a fabric pressing device.

This sewing machine further comprises a display panel 31 as shown in FIG. 3. This panel 31 includes a display section 27 having two 7-segment devices for displaying a pressing force in kilograms converted by a control system to be described later from a detection value output from the pressure sensor 19. The display panel 31 also includes an increase switch 28*a* and a decrease switch 28*b* for varying the pressing force, and a mode changeover switch 29 and a set switch 30 each containing a light emitting diode. The numerical value displayed on the display section 27 indicates the force applied to the presser foot 14. The display section 27 is capable of always indicating the force with which the feed dog is pressed even when the presser foot 14 has varied sizes.

Figure 4:
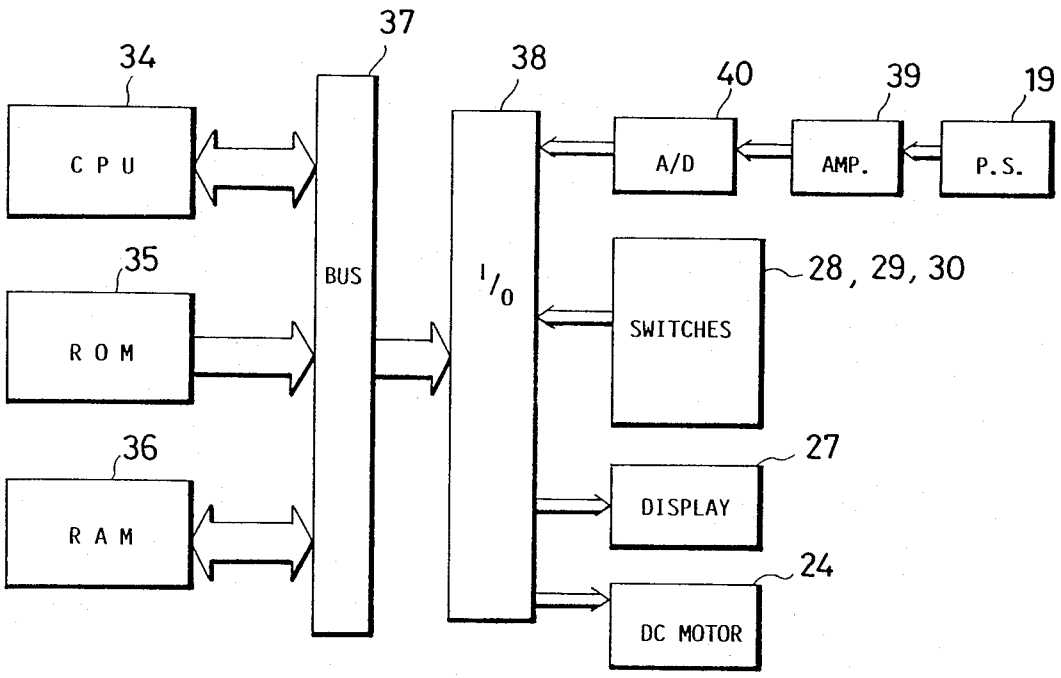
FIG. 4 is a block diagram of a control system for controlling the fabric pressing device.

FIG. 4 shows a control system 33 for converting the detection value provided by the pressure sensor 19 into the numerical value and for driving the DC motor 24. This control system 33 includes a CPU 34, a ROM 35, a RAM 36, a data bus 37 and an interface 38. The pressure sensor 19 is connected to the interface 38 through an amplifier 39 and an analog-to-digital converter 40. The described display section 27, switches 28-30, and DC motor 24 are connected through the interface 38 to CPU 34.

Figure 5:
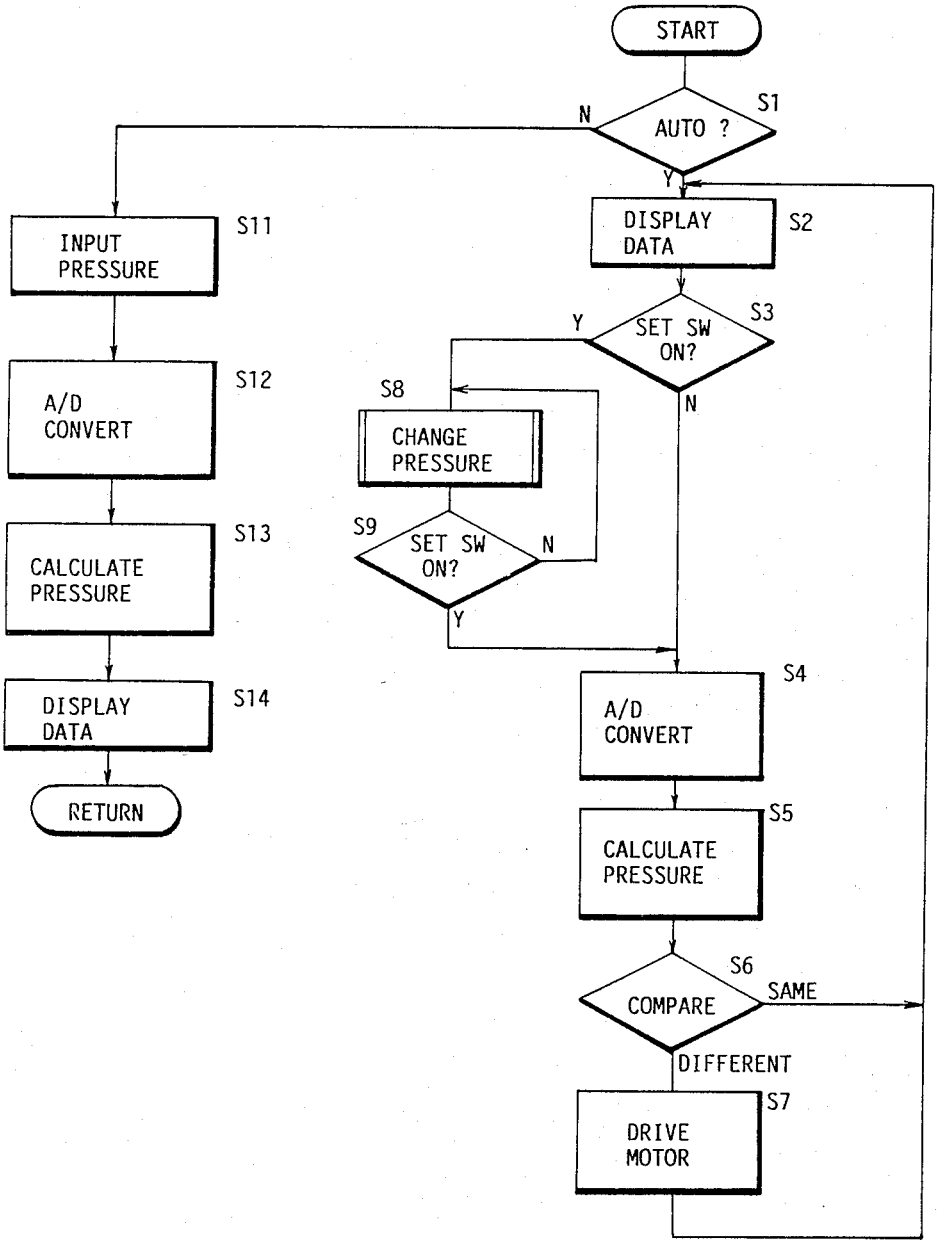
FIG. 5 is a flowchart illustrating an operation of the control system.

How this control system 33 operates will be described now with reference to the flowchart shown in FIG. 5. First, step S1 determines from an ON/OFF state of the mode switch 29 whether the pressing force of presser foot 14 is automatically adjusted or manually adjusted. In the case of automatic adjustment, the mode switch 29 is turned on to provide an AUTO mode, with an LED 29*a* lit. Then the program moves to step S2 for displaying current data stored in RAM 36. Next, step S3 checks whether the set switch 30 is turned on or not. If the set switch 30 is off, the program determines that the pressing force is not to be changed and moves to step S4. Step S4 is for converting an analog signal provided by the pressure sensor 19 into a digital signal for transmission to CPU 34. Next, step S5 calculates a pressing force from the digital signal and causes the pressing force to be stored. Step S6 compares the pressing force with the data currently displayed. If there is a difference between them, the program moves to step S7 and actuates the DC motor 24 to adjust the pressing force of presser foot 14. If no difference is found at step S6, there is no need for an adjustment to be made by means of the DC motor 24. Then the program returns to step S2 and repeats the above process.

For varying the pressing force during this auto adjust operation, the set switch 30 on the display panel 31 is turned on. This lights LED 30*a* of the set switch 30 and causes the program to move from step S3 to step S8. Step S8 allows operations of the increase switch 28*a* and decrease switch 28*b*, whereby the data currently displayed are changed. The program then moves to step S9 to check whether the set switch 30 is turned on again. If not, the program keeps moving back and forth between steps S8 and S9 until the set switch 30 is turned on. When the set switch 30 is turned on, the LED 30*b* goes off and the program moves to step S4 and subsequent steps for varying the pressing force of presser foot 14 in accordance with new data.

In the case of manual adjustment, the program moves from step S1 to step S11, which is a step for manual adjustment, as a result of the mode switch 29 being turned off with the LED 29*a* emitting no light. Step 11 allows the operator to turn the adjusting screw 11 manually for inputting a desired pressing force. Step S12 converts a corresponding analog signal provided by the pressure sensor 19 into a digital signal for transmission to CPU 34. Then, step S13 calculates the pressing force from the digital signal and causes the pressing force to be stored. Step S14 causes the current data to be displayed on the display section 27.

Reverting to FIG. 2, the thread regulating device 7 for applying tension to the threads extending to the needle 5 and the loopers includes a thread regulator 7A for applying tension to a thread extending to the needle 5, a thread regulator 7B for applying tension to a thread extending to an upper looper, and a thread regulator 7C for applying tension to a thread extending to a lower looper. All the regulators 7A–7C are arranged at upper positions of the main machine frame 8 as shown.

Each of the regulators 7A–7C includes a pair of tension discs 51 and 52 in pressure contact with each other under a resilient force of a spring 53. Thread S extends through a nip between these discs 51 and 52, and the pressure contact between the discs 51 and 52 applies an appropriate tension to thread S. One of the tension discs 51 is attached to a support disc 56 which is supported by one end of a bracket 55, the other end of bracket 55 being fixed by a screw to a casing 54 mounted on the main machine frame 8. The other tension disc 52 is supported by a bowl-like tension releasing disc 57 to which one end of the spring 53 is attached.

Figure 6:
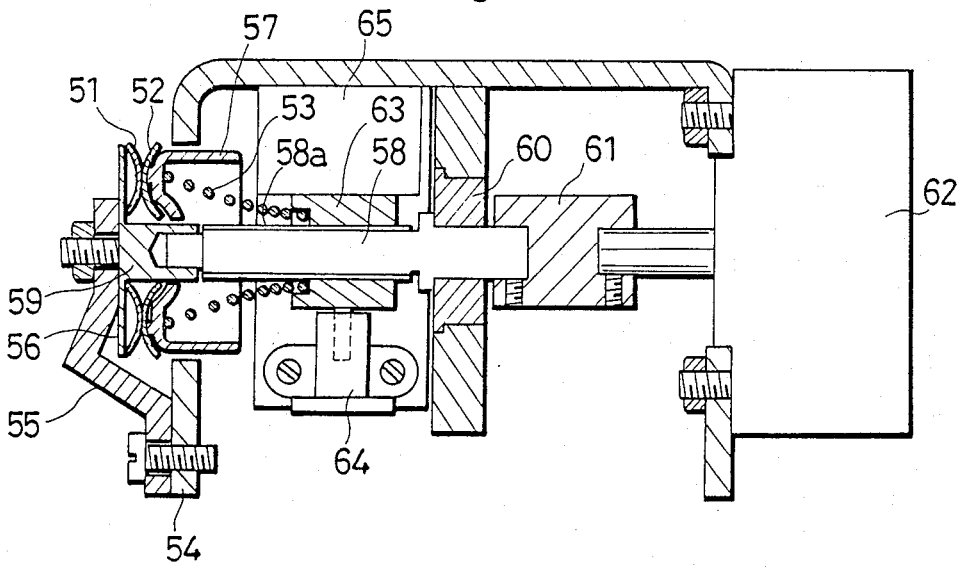
FIG. 6 is a partial view in section of a thread regulator in the embodiment of the invention.

As shown in FIG. 6, a bar member 59 is fixed to the bracket 55 for rotatably supporting one end of a tension stud 58. The tension releasing disc 57 is slidably mounted on the bar member 59 and tension stud 58. The tension stud 58 is rotatably supported by a bearing 60 inside the casing 54, with one end thereof extending into the bar member 59 as noted above and the other end connected to a stepper motor 62 through a coupling 61. The tension stud 58 defines a screw thread 58*a* on its periphery, and a movable block 63 receiving the other end of the spring 53 is placed in engagement with the screw thread 58*a*. The block 63 is held against rotation by a restrictor block 65, and is slidable axially of the tension stud 58 with rotations of the tension stud 58. An amount of compression of spring 53 varies with the movement of the movable block 63, thereby to adjust a value of tension the tension discs 51 and 52 apply to the thread. The position of movable block 63 to reduce the amount of compression of spring 53 to a minimum is called a zero point which is detected by a position sensor 64 such as a photocell disposed below the movable block 63.

Figure 7:
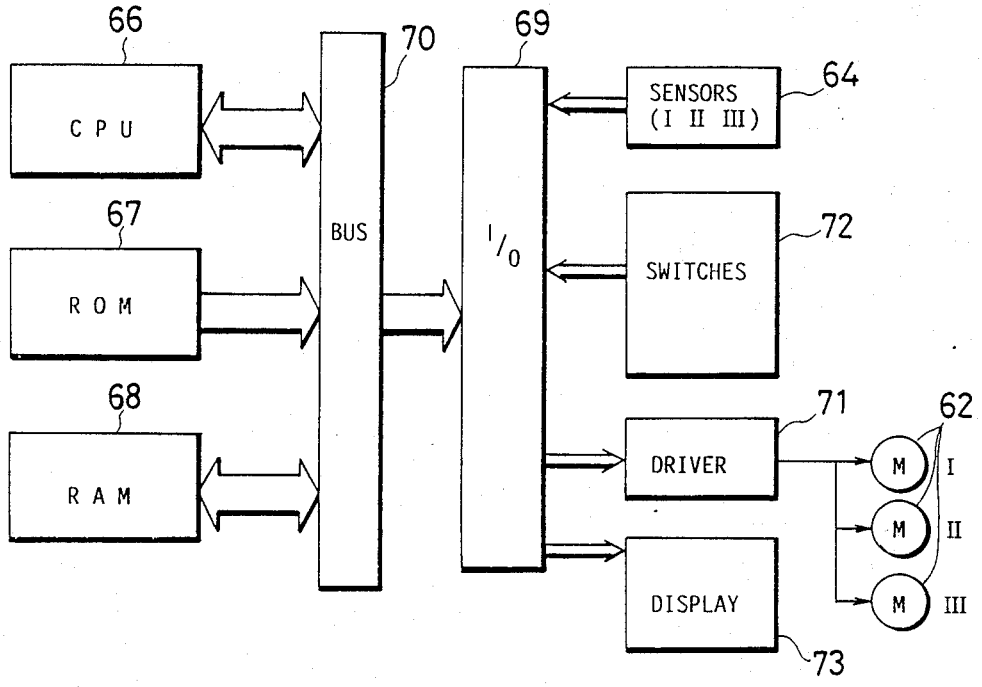
FIG. 7 is a block diagram of a control system for controlling the thread regulator.
Figure 8:
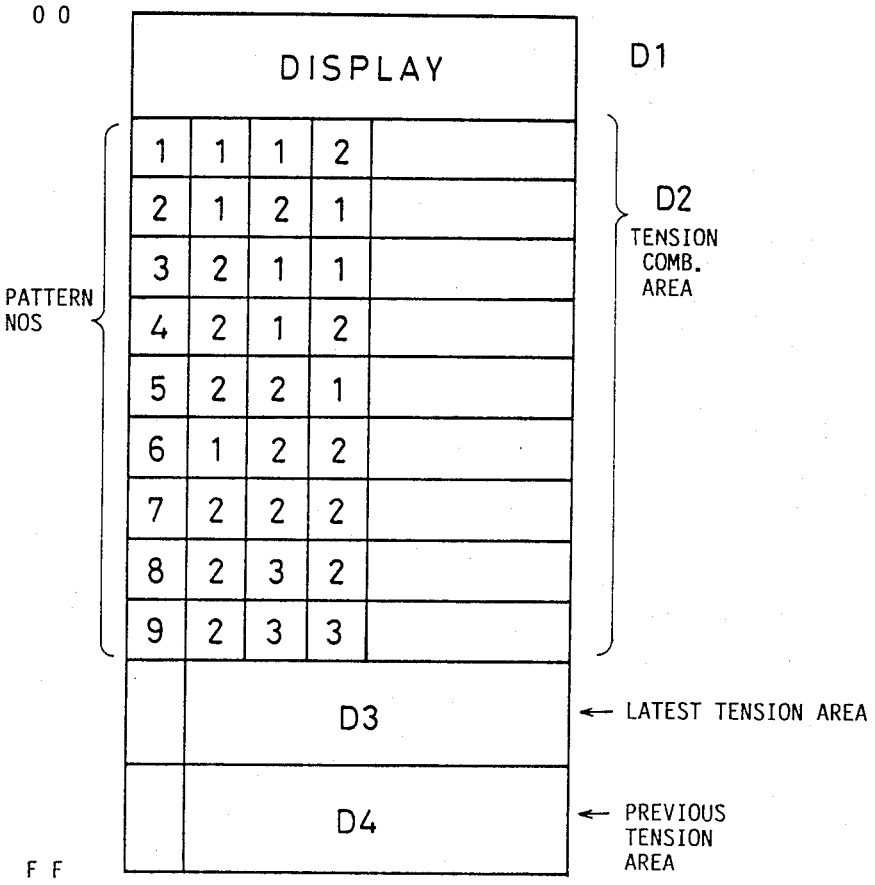
FIG. 8 is a memory map of a RAM included in the control system of FIG. 7.

The stepper motor 62 is controlled by a system shown in FIG. 7, to adjust the tension, the tension discs 51 and 52 apply to the thread to a selected amount. This system includes a CPU 66, a ROM 67, a RAM 68, an interface 69, and a data bus 70 interconnecting these circuits. The CPU 34, interface 38 and other elements in the control system described hereinbefore may be shared by the instant system. Number 71 indicates a drive circuit 71 for driving the stepper motors 62, number 72 indicates switches, and number 73 indicates displays. Data are stored in RAM 68 as illustrated in FIG. 8. In FIG. 8, reference D1 represents a display data storing area, and D2 a memory area for storing combinations of pattern numbers and tensions applied by the thread regulators 7A–7C. The first column from the lefthand side in this area shows the pattern numbers, the second column shows values of the tension applied by the thread regulator 7A, the third column shows values of the tension applied by the thread regulator 7B, and the fourth column shows values of the tension applied by the thread regulator 7C. Reference D3 represents a memory area for storing the latest tension values, and reference D4 represents a memory area for storing a tension value before renewal during a real-time operation.

Figure 9:
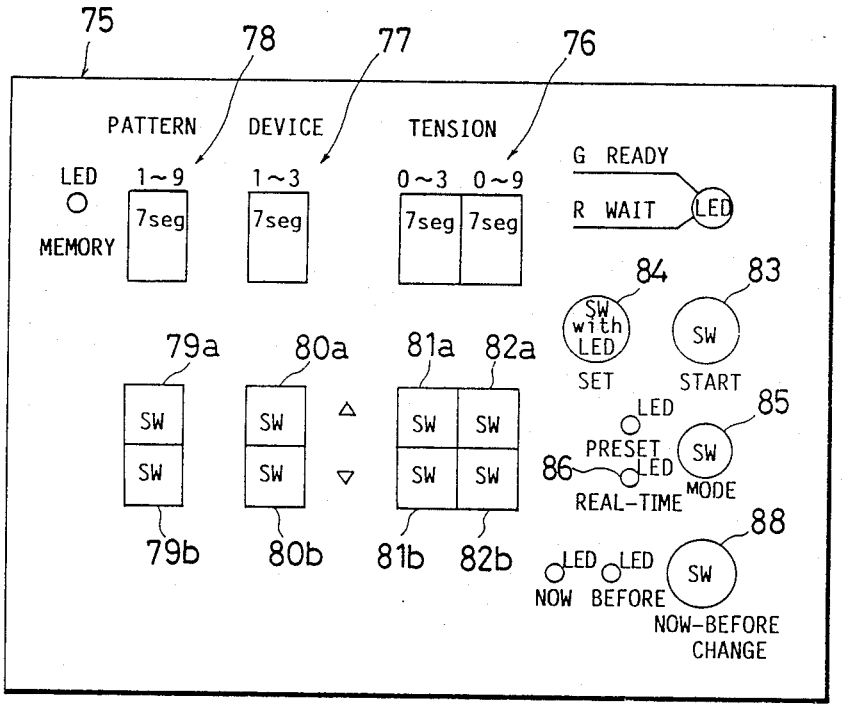
FIG. 9 is a front view of a control panel.

The switches 72 and display devices 73 are arranged on a control panel 75 as shown in FIG. 9. Number 76 in FIG. 9 indicates a display having two 7-segment display devices for displaying a value of tension applied to the thread. Number 77 indicates a regulator display for identifying, by means of a number, which one of the thread regulators 7A–7C applies the tension displayed on the display 76. Number 78 indicates a pattern display for displaying the pattern number corresponding to a combination of the tensions applied by the regulators 7A–7C set out in the RAM table of FIG. 7. The displays 77 and 78 has a 7-segment display device as does the display 76. Number 79*a* indicates a switch for changing the pattern number upward, and number 79*b* a switch for changing the pattern number downward. By operating these switches 79*a* and 79*b*, the pattern number shown on the display 78 may be changed to a desired number. Number 80*a* indicates a switch for changing the regulator identification number upward, and number 80*b* a switch for changing it downward. Numbers 81*a* and 82*a* indicate switches for changing the value of tension upward, and numbers 81*b* and 82*b* switches for changing it downward. Number 83 indicates a start switch. Number 84 indicates a set switch containing a light emitting diode. If this set switch 84 is pressed before operating the switches 79*a*, 79*b*, 80*a*, 80*b*, 81*a*, 81*b*, 82*a* and 82*b*, the pattern number, identification number of one regulator, and the value of tension are changed and stored in the memory areas. Number 85 indicates a mode change switch for selecting between a preset mode and a real-time mode in which the sewing machine is operated as described later.

Figure 10:
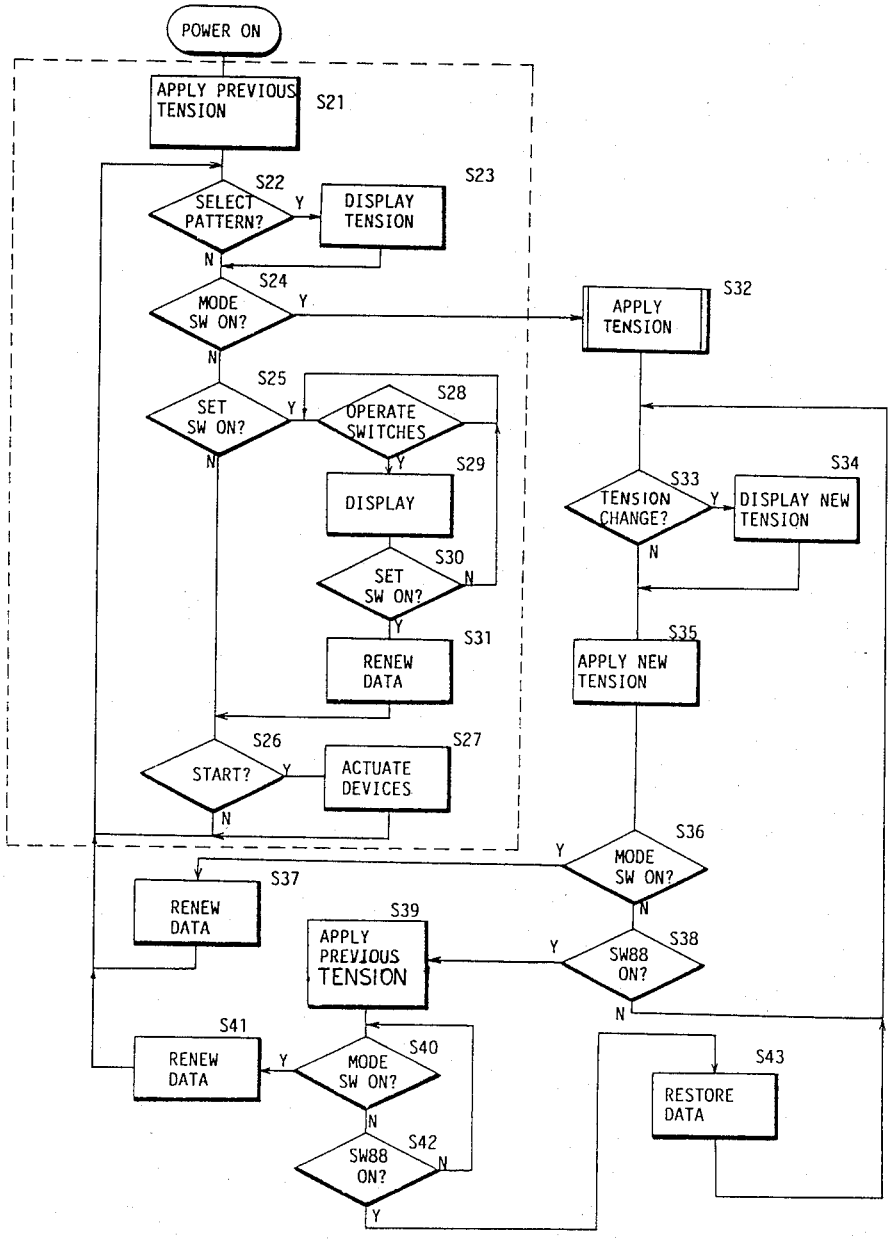
FIG. 10 is a flowchart illustrating an operation of the control system of FIG. 7, and FIGS. 11 through 13 are explanatory views illustrating changes of data stored in the RAM included in the control system of FIG. 7, respectively.

FIG. 10 is a flowchart illustrating an operation of the system shown in FIG. 7. In FIG. 7, the portion of flow enclosed in the broken line corresponds to the preset mode, and the remaining portion corresponds to the real-time mode.

When the sewing machine is turned on, step S21 reads the values of tension having been applied when the machine was turned off, and apply these values to the thread regulators 7A–7C. This tension application is effected by turning the stepper motor 62 backward to return the movable block 63 to the zero-point first and then turning the motor 62 forward by applying a predetermined number of forward drive pulses thereto. RAM 68 is backed up during the power-off period, and therefore the tension values remain stored in the memory area D3 through this period. When the power is turned on, these values are written into the display memory area D1 to be shown on the display 76. This data transfer within the RAM is illustrated in the top row in FIG. 11.

When the switches 79*a*, 79*b*, 80*a* and 80*b* are operated to select a pattern and one or more thread regulators for change of tension at step S22, the program moves from step S22 to step S23 for changing the data shown on the displays 78 and 73 accordingly. FIG. 11 shows in the second row the case of pattern No. 2 being selected. Then, the program moves to step S26 if neither of the mode switch 85 and set switch 84 is pressed. When the start switch 83 is pressed at step S26, the program moves to step S27 and adjusts all of the thread regulators 7A–7C according to the designated pattern. At this time, a data transfer takes place in RAM 68 as illustrated in the bottom row of FIG. 11, whereby the data in the memory area D1 are written into the memory area D3. The above sequence is repeated unless the mode switch 85 or set switch 84 is pressed, to set the thread regulators 7A–7C to the values of tension corresponding to selected pattern numbers. When the identification number of one of the regulators 7A–7C is selected at step S22, the display 76 shows the value of tension for this regulator.

If the set switch 84 is pressed at step S25, the LED contained therein emits light indicating that changes in the pattern and tension are allowed. When the operator presses the switches to change patterns and thread regulators, and increase and/or decrease the tension, the program moves to step S29 to display new values. When the operator presses the set switch 84 again, which turns off the LED, after completing the change operation, the program moves from step S30 to step S31 and renews the data stored in RAM 68. Thereafter, when the start switch 83 is pressed at step S26, the program moves to step S27 and operates the thread regulators 7A–7C according to the renewed data. The above operation causes a data transfer and rewriting to take place as illustrated in FIG. 12. FIG. 12 illustrates an example where the values of tension for the respective regulators are changed from 1, 2 and 1 to 2, 3 and 2. This operation is called the preset mode.

Figure 13:
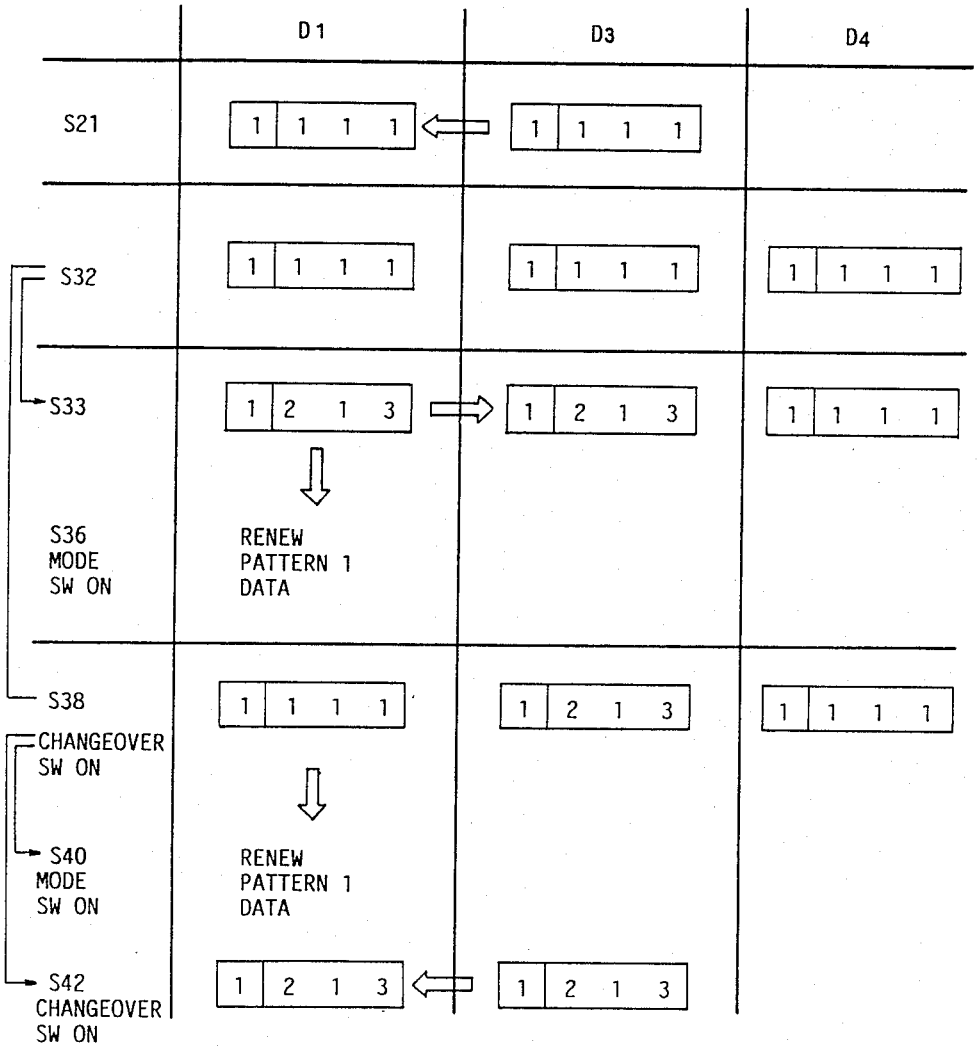

If the mode switch 85 is pressed at step S24, the program moves to steps S32 et seq. for the real-time mode. In this mode, the memory area D1 of RAM 68 changes into a memory area for storing the data for display and actual tension values of the thread regulators, the memory area D3 into an area for storing new data, and the memory area D4 is used for storing the data before renewal. Thus, when the mode switch 85 is pressed at step S24, the data in the memory area D1 are also written into the area D4 as shown in FIG. 13. Since the memory area D1 stores the actual tension values as well as the data for display, the thread regulators 7A–7C immediately start operating in the combination of tension values corresponding to the displayed pattern (step S32). When the mode switch 85 is pressed once, LED 86 on the control panel 75 emit light to notify the operator that the machine is running in the rear-time mode.

When the switches 79*a*, 79*b*, 80*a*, 80*b*, 81*a* and 81*b* are operated at step S33 to increase or decrease the tension for each thread regulator, the program moves to step S34 for displaying the new values. Then the new data 2, 1 and 3 are written into the memory area D1 of the RAM as shown in FIG. 13, the tension of each thread regulator is changed in real time to the new value at step S35. These new data are also stored in the memory area D3.

When, at step S36, the mode switch 85 is pressed again after the desired tension adjustment is completed as above, the pattern data for display are renewed at step S37 and the real-time mode comes to an end.

If the mode switch 85 is not pressed at step S36, the program moves to step S38 to check whether a "NOW-BEFORE" changeover switch 88 is pressed or not. If it is, the data stored in the memory area D1 of RAM 68 are replaced by the data 1, 1 and 1 stored in the memory area D4, and these data are displayed and used to actuate the thread regulators at step S39. Next, if the mode switch 85 is pressed at step S40, the displayed pattern data returns to the data before the renewal (step S41) which ends the real-time mode.

If the mode switch 85 is not pressed at step S40, the program moves to step S42 to check whether the "NOW-BEFORE" switch 88 is pressed or not. If it is, the data stored in the memory area D3 are written into the memory area D1 at step S43 for the thread regulators to operate in real time according to this data. The real-time mode thus allows the tension for each thread regulator to be adjusted in real time, and the data before and after the change to be stored in the two memory areas D3 and D4 of the RAM. The tension before the change may be restored at any time by operating the "NOW-BEFORE" changeover switch 88. Consequently, the operator may vary or adjust the tension of each thread to an optimal value for operating the sewing machine.

What is claimed is:

1. A thread regulating apparatus for a sewing machine to make a seam by using plural threads simultaneously, having a plurality of thread regulators each nipping the thread to apply tension to the thread, the tension being variable by changing a nip pressure, said apparatus comprising:

memory means, comprising a RAM, for storing combination patterns of tension values of the threads, each tension value being applied by its respective thread regulator according to the balance of the tension values between the regulators, selecting means for selecting one of the combination pattern stored in said memory means, and adjusting means for adjusting the nip pressure of each thread regulator individually in accordance with the selected combination pattern.

2. A thread regulating apparatus as claimed in claim 1, wherein each thread regulator included a pair of tension discs and urging means for maintaining said tension discs in pressure contact with each other.

3. A thread regulating apparatus as claimed in claim 2, wherein said urging means is interposed between one of said tension discs and a movable block driven by drive means, said urging means having an amount of compression adjustable by actuating said drive means to move said movable block toward and away from said tension discs.

4. A thread regulating apparatus as claimed in claim 1, wherein said selecting means includes a switch for varying a pattern number shown on display means.

5. A thread regulating apparatus as claimed in claim 3, wherein said drive means includes a stepper motor and a tension stud extending through and engaging said movable block for moving said movable block toward and away from said tension discs with rotations of said stepper motor.

6. A thread regulating apparatus as claimed in claim 5, wherein said drive means further includes a detecting element for detecting a zero-point position of said movable block at which the amount of compression of said urging means is minimum, the tension applied to each thread being variable by an amount of movement of said movable block from said zero-point position.

7. A thread regulating apparatus for a sewing machine having a plurality of thread regulators each nipping a thread to apply tension to the thread, the tension being variable by changing a nip pressure, said apparatus comprising;

memory means for storing values of the tension of the thread applied by each thread regulator according to combination patterns of the values of the tension for the respective threads, selecting means for selecting one of the combination patterns stored in said memory means, varying means for varying thread tension data in the selected combination pattern, renewal means for renewing pattern data stored in said memory means with the tension data varied by said varying means, switch means for restoring the pattern data stored in said memory means prior to the renewal, display means for displaying new pattern data, and adjusting means for adjusting the nip pressure of each thread regulator in accordance with the new pattern data.

8. A thread regulating apparatus as claimed in claim 7, wherein each thread regulator includes a pair of tension discs and urging means for maintaining said tension discs in pressure contact with each other.

9. A thread regulating apparatus as claimed in claim 8, wherein said urging means is interposed between one of said tension discs and a movable block driven by drive means, said urging means having an amount of compression adjustable by actuating said drive means to move said movable block toward and away from said tension discs.

10. A thread regulating apparatus as claimed in claim 7, wherein said memory means includes a RAM table for storing, as associated with pattern numbers, the combination patterns of the values of the tension applied to the threads by said thread regulators.

11. A thread regulating apparatus as claimed in claim 7, wherein said selecting means includes a switch for varying a pattern number shown on display means.

12. A thread regulating apparatus as claimed in claim 9, wherein said drive means includes a stepper motor and a tension stud extending through and engaging said movable block for moving said movable block toward and away from said tension discs with rotations of said stepper motor.

13. A thread regulating apparatus as claimed in claim 12, wherein said drive means further includes a detecting element for detecting a zero-point position of said movable block at which the amount of compression of said urging means is minimum, the tension applied to each thread being variable by an amount of movement of said movable block from said zero-point position.

14. A thread regulating apparatus as claimed in claim 7, wherein said varying means includes switches for increasing and decreasing the tension data displayed by said display means.

15. A thread regulating apparatus as claimed in claim 7, wherein further comprising a mode change means for selecting between a real-time mode and a preset mode, the nip pressure of each thread regulators being determined in said real-time mode by the pattern data displayed by said display means.

16. A thread regulating apparatus claimed in claim 1, wherein said memory means stores at least three combination patterns of tension values.

17. A thread regulating apparatus for a sewing machine to make a seam by using plural threads simultaneously, having a plurality of thread regulators each nipping the thread to apply tension to the thread, the tension being variable by changing a nip pressure, said apparatus comprising:

memory means, comprising a RAM, for storing combination patterns of tension values of the threads, as associated with combination pattern numbers, each tension value being applied by its respective thread regulator according to the balance of the tension values between the regulators, selecting means for selecting one of the combination patterns stored in said memory means, and adjusting means for adjusting the nip pressure of each thread regulator individually in accordance with the selected combination pattern.

* * * * *